US007507120B1

(12) United States Patent
Bright et al.

(10) Patent No.: US 7,507,120 B1
(45) Date of Patent: Mar. 24, 2009

(54) SHIELDING ELEMENT FOR AN ELECTRICAL CONNECTOR MODULE ASSEMBLY

(75) Inventors: Edward John Bright, Middletown, PA (US); Steven David Dunwoody, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/946,962

(22) Filed: Nov. 29, 2007

(51) Int. Cl.
*H01R 9/03* (2006.01)

(52) U.S. Cl. ..... 439/610; 439/731; 439/906

(58) Field of Classification Search ..... 439/610, 439/731, 906
See application file for complete search history.

(56) References Cited

U.S. PATENT DOCUMENTS

| | | | | |
|---|---|---|---|---|
| 4,619,487 | A * | 10/1986 | Brush, Jr. | 439/98 |
| 5,029,254 | A | 7/1991 | Stickney | |
| 5,233,507 | A | 8/1993 | Gunther et al. | |
| 5,466,175 | A * | 11/1995 | Onoda | 439/610 |
| 5,511,993 | A * | 4/1996 | Yamada et al. | 439/610 |
| 5,836,774 | A * | 11/1998 | Tan et al. | 439/76.1 |
| 6,676,137 | B2 | 1/2004 | Dean | |

* cited by examiner

*Primary Examiner*—Tho D Ta

(57) ABSTRACT

An electrical connector module assembly is provided and includes first and second shells that mate together along an interface extending along a length of the shells. The first and second shells form a cavity therebetween that extends along the length of the shells. The cavity is configured to hold an electrical component therein, and the first shell has an interior surface. The module assembly also includes a shielding element that has a major body located along the interior surface of the first shell. The shielding element also includes a spring member that is coupled to the major body and located within the interface. The spring member is compressed between the first and second shells.

20 Claims, 4 Drawing Sheets

SHIELDING ELEMENT FOR AN ELECTRICAL CONNECTOR MODULE ASSEMBLY

BACKGROUND OF THE INVENTION

The subject matter herein relates generally to electrical connector assemblies, and more particularly, to pluggable module assemblies that are configured to reduce electromagnetic interference leakage through seams in the housing.

Pluggable module assemblies allow users of electronic equipment or external devices to transfer data to or communicate with other equipment and devices. These module assemblies are generally constructed according to established standards for size and compatibility (e.g., Small Form-factor Pluggable (SFP), XFP, or Quad Small Form-factor Pluggable (QSFP)). The XFP and QSFP standards require that the module assemblies be capable of transmitting data at high rates, such as 10 gigabits per second. As the signal transmission rates increase, the circuitry within the module assemblies generates larger amounts of electromagnetic energy at shorter wavelengths, which increases the likelihood for electromagnetic energy passing through any seams or gaps formed by the module assemblies. Thus, adjacent module assemblies may experience more electromagnetic interference (EMI), which can interrupt, obstruct, or otherwise degrade or limit the effective performance of the module assemblies and nearby circuitry. Moreover, the energy radiating through the seams or gaps may cause radio frequency interference (RFI) that affects nearby circuitry and/or receivers.

Various devices have been proposed for shielding electrical equipment and connectors from electromagnetic energy. In one conventional device, as described in U.S. Pat. Nos. 5,233,507 and 6,676,137, an EMI gasket clip is used to seal a longitudinal gap formed between two walls that have surfaces that lie adjacent to each other. The gasket clip includes a U-bend having two wings projecting therefrom. The two wings form a tight clamp that is configured to flex around a thickness of a first wall and grip the two longitudinal surfaces of the first wall. One of the wings includes a plurality of spring members that flex outwardly with respect to the wing and, consequently, outwardly with respect to one of the longitudinal surfaces of the first wall. When the first wall is positioned to lie adjacent to a second wall, the spring members deflect against a surface of the second wall thereby at least partially sealing the gap. The conventional EMI gasket clip may be operable with two walls that lie adjacent to each other, but the EMI gasket clip may not work when edges of the first and second walls are abutting each other (i.e., edge-to-edge). Furthermore, conventional gasket clips, such as the gasket clip described above, are generally small and difficult to manipulate or control while assembling the electrical device or module assembly.

In one proposed system, a module housing is formed by mating two shells together along edges of the shells and thereby forming an interface that may include a longitudinal gap. After the module housing is constructed, an automated system dispenses a conductive elastomer into the housing cavity in order to form EMI shielding within the seams. Applying this system, however, can be expensive and/or time consuming.

Thus, there is still a need for a shielding element that reduces EMI leakage through a seam formed by two wall edges abutting each other. Further, there is still a need for a shielding element that may be more easily manipulated or controlled during the assembly process. In addition, more inexpensive assemblies and manufacturing processes are also desired.

BRIEF DESCRIPTION OF THE INVENTION

In one embodiment, an electrical connector module assembly is provided and includes first and second shells that mate together along an interface extending along a length of the shells. The first and second shells form a cavity therebetween that extends along the length of the shells. The cavity is configured to hold an electrical component therein, and the first shell has an interior surface. The module assembly also includes a shielding element that has a major body located along the interior surface of the first shell. The shielding element also includes a spring member that is coupled to the major body and located within the interface. The spring member is compressed between the first and second shells.

Optionally, the spring member is configured to flex away from the first shell and against the second shell when compressed between the first and second shells. Also, the module assembly may include a plurality of spring members, where each spring member is configured to flex against the second shell when compressed between the first and second shells.

In another embodiment, an electrical module assembly is provided. The module assembly includes a housing that has a front end and a rear end having an opening into a cavity. The housing is formed from first and second shells that mate together along an interface extending along a length of the shells. The first and second shells form the cavity therebetween and the cavity extends along the length of the shells. The cavity is configured to hold an electrical component therein, and the first shell has an interior surface. The module assembly also includes a shielding element that has a major body located along the interior surface of the first shell. The shielding element also includes a spring member that is coupled to the major body and located within the interface. The spring member is compressed between the first and second shells. In addition, the module assembly includes a cable that extends into the cavity through the rear opening of the housing. The cable is electrically connected to the electrical component.

DETAILED DESCRIPTION OF THE INVENTION

Figure 1:
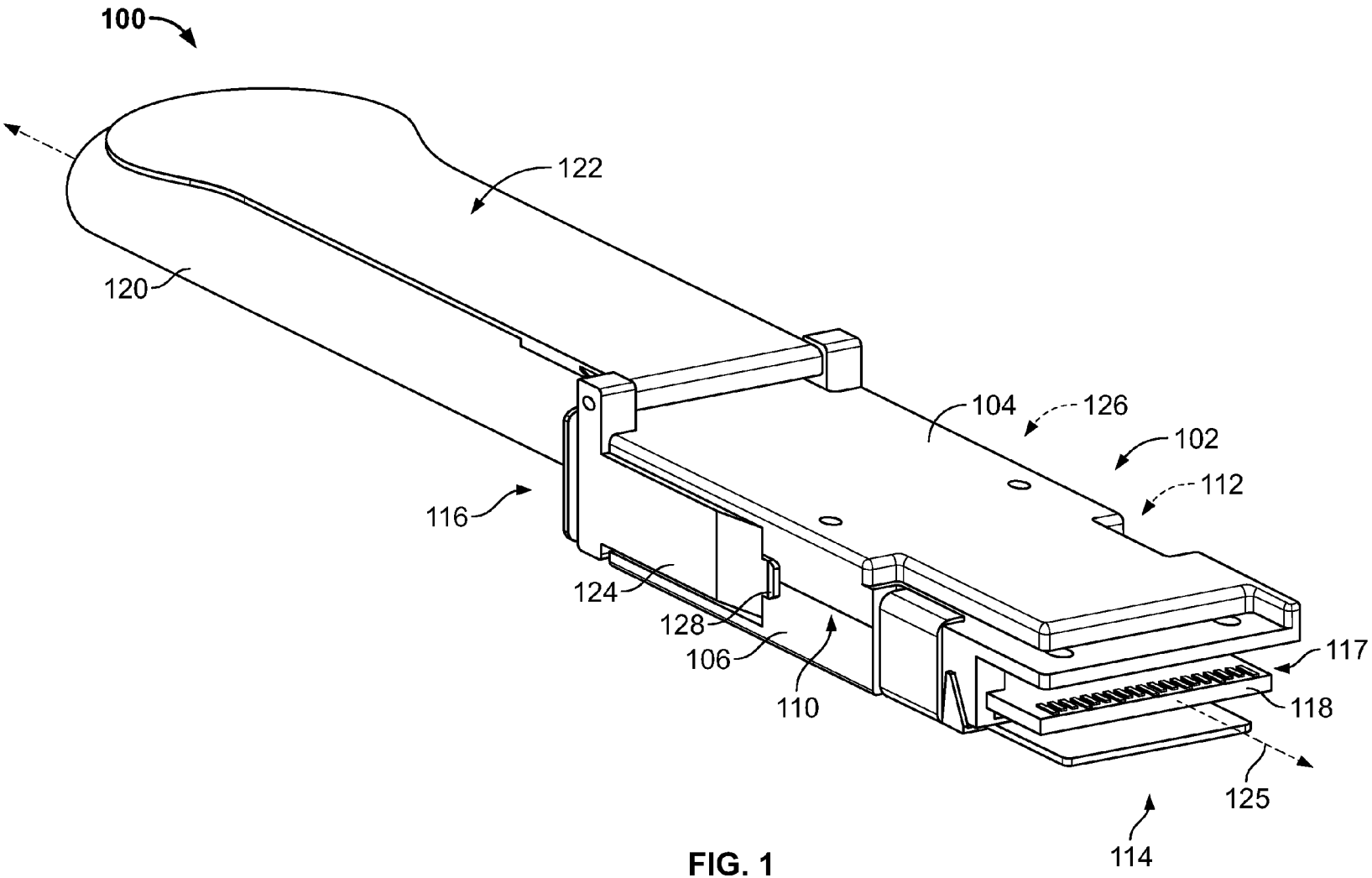
FIG. 1 is a perspective view of an electrical connector module assembly formed in accordance with one embodiment.

FIG. 1 is a perspective view of an electrical connector module assembly 100 formed in accordance with one embodiment. The module assembly 100 includes a housing 102 that may be formed from two housing shells 104 and 106 that mate or engage with each other along interfaces 110 and 112, only a portion of which is shown in FIG. 1. The shells 104 and 106 may have conductive surfaces. The module assembly 100 has a front end 114, a rear end 116, and a cavity 108 (FIG. 5) that extends lengthwise from the front end 114 to the rear end 116. The front end 114 is configured for pluggable insertion into a receptacle assembly (not shown) that is attached to a host electronic system (e.g., computer) or an electronic device (not shown). The front end 114 includes an electrical component 117, which is illustrated in FIG. 1 as a circuit board 118, configured to couple with the electronic system or device in order to establish an electrical connection. The module assembly 100 also includes a cable 120 that extends into the cavity 108 from the rear end 116 and connects with the circuit board 118 within the housing 102 using one or more conductors (not shown). The module assembly 100 may be used to convey data signals from one electrical device to another, and more particularly to convey data signals at high frequencies, such as 10 gigabits per second (Gbs). When in operation, the data signals transmit through the cable 120 and corresponding conductors generally along a longitudinal transmission axis 125 and into the circuit board 118, which is engaged within the receptacle assembly. In one embodiment, the module assembly 100 is a direct attach module assembly 100 that is configured to be a Small Form-factor Pluggable (SFP), XFP, or Quad Small Form-factor Pluggable (QSFP) connector.

In addition, the module assembly 100 may include a tab 122 that couples to the rear end 116 and facilitates gripping and removing the module assembly 100 from the receptacle assembly. For example, the tab 122 may be coupled to a pair of slidable actuators 124 and 126 that include ejector latches 128. The ejector latches 128 engage sides of the receptacle assembly (not shown). When the tab 122 is pulled in a front-to-rear direction, the actuators 124 and 126 slide rearward thereby disengaging the latches 128 from the receptacle assembly and allowing the module assembly 100 to be removed.

As will be described in further detail below, embodiments described herein utilize a shielding element 160 (FIG. 2) for reducing or avoiding electromagnetic interference (EMI) leakage through seams or longitudinal gaps, such as those that may extend along interfaces 110 and 112. More specifically, the seams may occur where edges of housing components, such as the shells 104 and 106, abut each other. Although the embodiments are described with specific reference to the module assembly 100, the shielding element 160 may be used with other electrical connectors that include seams or longitudinal gaps and, more specifically, that include seams or longitudinal gaps that extend parallel and adjacent to the transmission axis 125.

Figure 2:
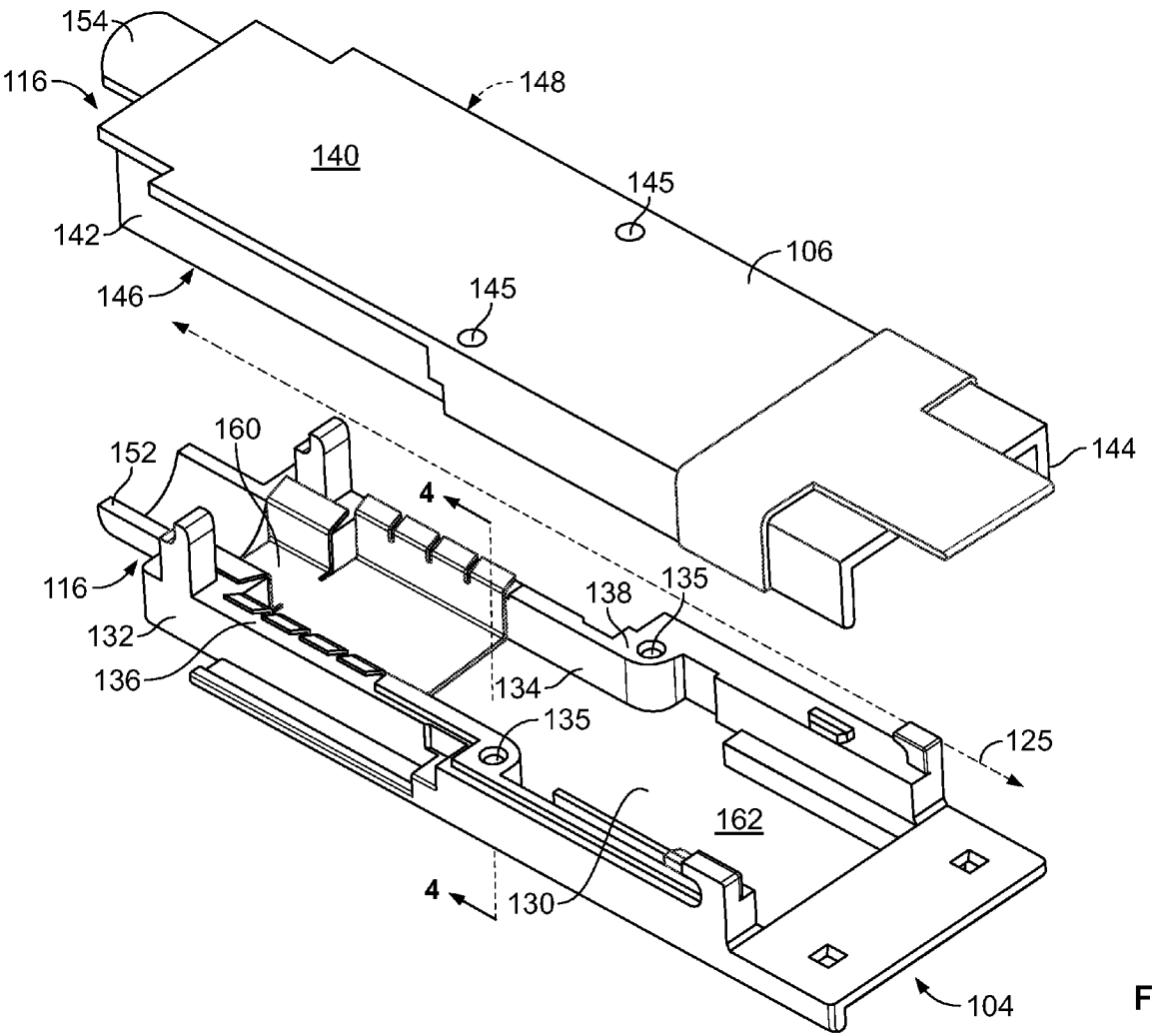
FIG. 2 is an exploded view of two shells that may be used to form the module assembly shown in FIG. 1.

FIG. 2 is an exploded perspective view of the shells 104 and 106 before the shells 104 and 106 are mated with each other to form the module assembly 100 (FIG. 1). The shells 104 and 106 may have an open-faced rectangular shape. More specifically, the shell 104 may include an interior wall 130 and opposing sidewalls 132 and 134 that are connected by the interior wall 130, which extends therebetween. In FIG. 2, the opposing sidewalls 132 and 134 form planes that are parallel with respect to each other and extend parallel to the transmission axis 125. However, alternative embodiments may include sidewalls 132 and 134 that are not parallel and do not oppose each other. As shown, the inner surfaces of the interior wall 130 and the sidewalls 132 and 134 form a shell interior surface 162. As shown in FIG. 2, the interior wall 130 and the sidewalls 132 and 134 form a channel that generally extends parallel to or along the transmission axis 125. Likewise, the shell 106 may include an interior wall 140 and opposing sidewalls 142 and 144 that are connected by the interior wall 140, which extends therebetween. Although not shown, the inner surfaces of the sidewalls 142 and 144 and the interior wall 140 may form an interior surface (not shown) that may be similarly shaped to the interior surface 162 and also generally extend parallel to or along the transmission axis 125. Also shown in FIG. 2, the shells 104 and 106 each include a semi-circular cable extension 152 and 154, respectively, that projects from the rear end 116 of the respective shell. When the cable extensions 152 and 154 are joined together, the cable extensions 152 and 154 form a strain-relief extension that includes an opening (not shown) for receiving the cable 120 (FIG. 1).

Furthermore, the sidewalls 132 and 134 each have a mating edge 136 and 138, respectively, and the sidewalls 142 and 144 each have a mating edge 146 and 148, respectively. The mating edges 136 and 138 and the mating edges 146 and 148 are conformed to mate with each other when the module assembly 100 (FIG. 1) is formed and may include substantially planar surfaces that abut each other when the shells 104 and 106 are mated together. Also, the sidewalls 132 and 134 may form fastening holes 135, and the sidewalls 142 and 144 may form fastening holes 145 that align with fastening holes 135 when the shells 104 and 106 are mated. When the module assembly 100 is formed, the shell 106 is lowered onto the shell 104 such that the mating edges 136 and 146 join together along the interface 110 (FIG. 1) and the mating edges 138 and 148 join together along the interface 112 (FIG. 1). Fastening devices, e.g., screws, may then be inserted into the aligned fastening holes 145 and 135 and tightened so that the shells 104 and 106 are mated securely. Although the mating edges 136, 138, 146, and 148 may have substantially planar surfaces, gaps may develop between corresponding abutting mating edges due to manufacturing tolerances, creep and/or fatigue of the module assembly 100, or looseness in the fastening devices. As the gaps widen, the risk of EMI leakage increases especially for the portions of the interfaces 110 and 112 that are located away from the fastening holes 135 and 145.

Figure 3:
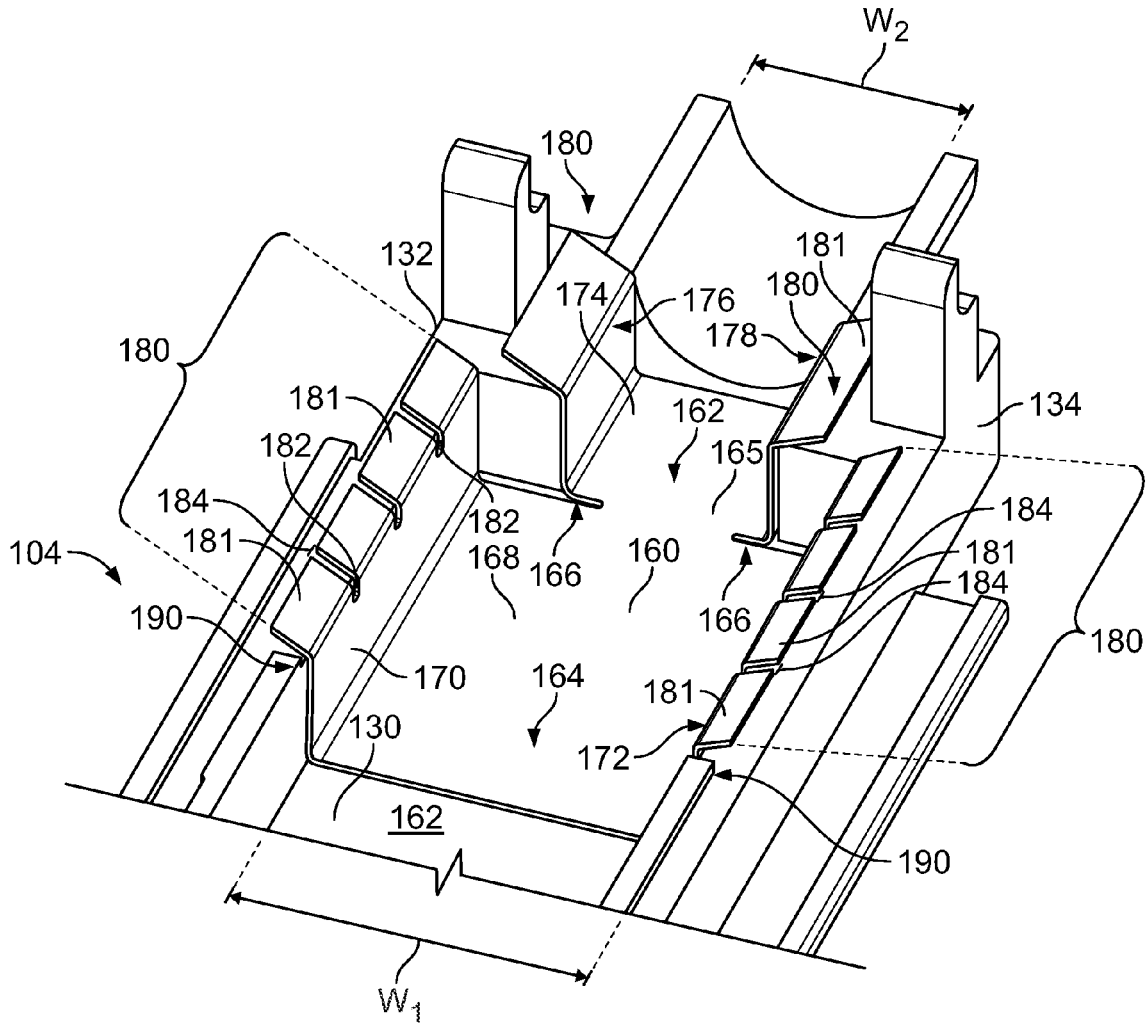
FIG. 3 is an enlarged perspective view of one shell from FIG. 2.

In order to reduce or avoid EMI leakage through the seams located along the interfaces 110 and 112, at least one of the shells 104 and 106 may have a shielding element 160 that is positioned within the shell 104 and/or 106. The shielding element 160 may be stamped and formed from sheet metal. Alternatively, the shielding element 160 may be formed by an injection molding process using a resin that includes conductive particles. When the module assembly 100 is formed, the shielding element 160 is placed within the shell 104. Then the cable 120 (FIG. 1) and circuit board 118 (FIG. 1) and/or other electronic circuitry is placed on top of the shielding element 160 before the shell 106 is lowered onto the shell 104. FIG. 3 is an enlarged perspective view of the shell 104 holding the shielding element 160. In FIGS. 2 and 3, the shielding element 160 is positioned proximate to the rear end 116 of the corresponding shell 104, however, the shielding element 160 in alternative embodiments may be placed anywhere within the shell 104 provided that the shielding element 160 may function as described herein.

As shown in FIG. 3, the shielding element 160 is conformed to fit the interior surface 162 of the shell 104. Although the interior surface 162 has a rectangular shape in FIG. 3, the interior surface 162 may have other shapes or configurations. For example, the interior wall 130 may be semi-circular (concave or convex) or shaped like a trough instead of being substantially planar. Also, the sidewalls 132 and 134 may form a non-orthogonal angle with respect to the interior wall 130 instead of a perpendicular angle as shown in FIG. 3. Furthermore, the interior surface 162 and/or interior wall 130 may have varying widths. In FIG. 3, the interior surface 162 and/or the interior wall 130 has a main channel width $W_1$ and a minor channel width $W_2$, where the main channel width $W_1$ is configured to be wide enough so that the cavity 108 may hold the circuit board 118 (FIG. 1) and the minor channel width $W_2$ is configured to be wide enough to receive the cable 120 (also shown in FIG. 1).

When the interior surface 162 and/or the interior wall 130 have varying widths, the shielding element 160 may include a plurality of sections for adjusting to the varying widths. More specifically, as shown in FIG. 3, the shielding element may have a main section 164 and a minor section 165 that are partially separated by section recesses 166. Alternatively, separate shielding elements 160 may be used instead of one shielding element 160 with multiple sections 165 and 164. The main section 164 includes a major body 168 and lateral extensions 170 and 172 that are connected by the major body 168 and project upward along the sidewalls 132 and 134, respectively. Likewise, the minor section 165 includes a minor body 174 and lateral extensions 176 and 178 that are connected by the minor body 174 and project upward along the sidewalls 132 and 134, respectively.

The lateral extensions 170, 172, and 176, 178 may form a spring member 180 that bends and projects outwardly into the space between the corresponding mating edges (e.g., mating edges 136 and 146 in FIG. 2). Each spring member 180 may be substantially planar and have a substantially constant thickness. The spring member 180 may bend about a mating corner 182 where the sidewalls 132 and 134 intersect the corresponding mating edge 136 and 138, respectively. More specifically, a plane formed by the spring member 180 creates a non-orthogonal angle with respect to a plane formed by the corresponding lateral extension. In FIG. 3, the lateral extensions 170 and 172 each have a spring member 180 that includes a plurality of spring fingers 181. Each spring finger 181 is separated from the adjacent spring finger(s) 181 by a spring recess 184. Using a plurality of spring fingers 181 may account for gaps that do not remain consistent as the gap extends along the corresponding interface. The depth of the spring recesses 184 can affect the flexibility and/or the force necessary to compress the respective spring member 180 and corresponding spring fingers 181. For example, the spring recess 184 may extend from an outer edge of the spring finger 181 to slightly past the mating corner 182 (as shown in FIG. 3), or the spring recess 184 may extend further toward the interior wall 130. A greater depth of the spring recesses 184 generally corresponds with greater flexibility of the corresponding spring member 180 and corresponding spring fingers 181.

The mating edges 136 and 138 (FIG. 2) may each have an offset 190 (shown in FIG. 3) formed into the surface of the corresponding mating edge(s) in order to account for the thickness of the spring member 180 when the spring member 180 is compressed within the corresponding interface. Furthermore, the offsets 190 may be conformed to fit within the gaps formed by the spring recesses 184 between the spring fingers 181.

Figure 4:
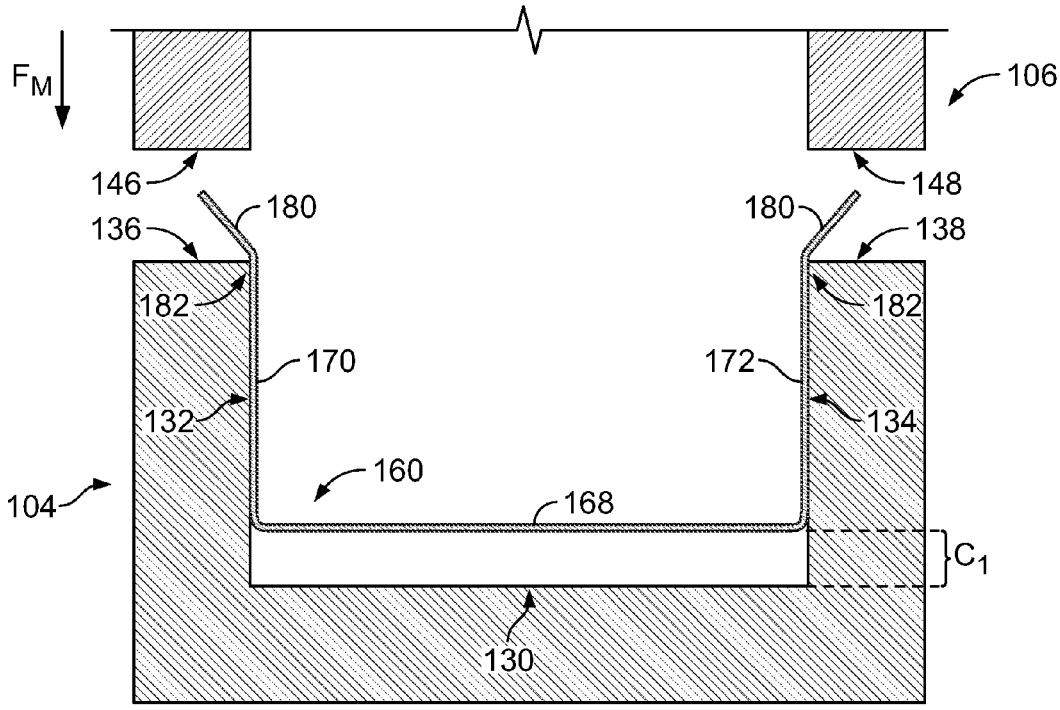
FIG. 4 is a cross-section of the shells shown in FIG. 2 before the two shells are mated together.
Figure 5:
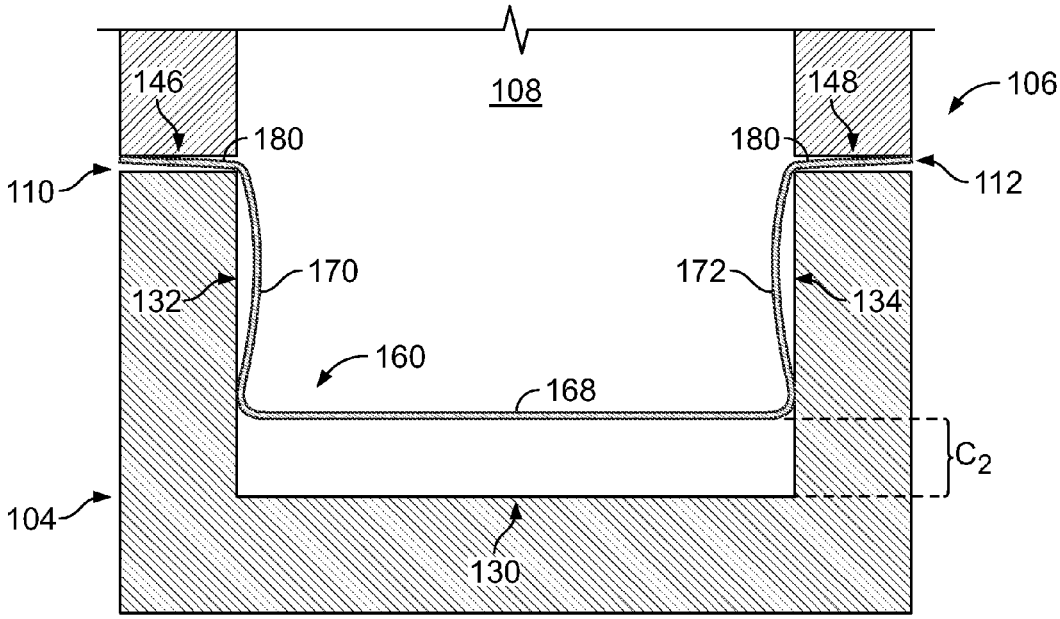
FIG. 5 is a cross-section of the shells shown in FIG. 2 after the two shells are mated together.

FIGS. 4 and 5 illustrate the force-deflection behavior of the spring members 180 and corresponding lateral extensions 170 and 172. (The following discussion may similarly be applied to spring fingers 181.) More specifically, FIG. 4 shows a cross-section of the shell 104 and the shielding element 160 taken along the line 4-4 in FIG. 2, and FIG. 5 shows a cross-section of the mated shells 104 and 106. (For illustrative purposes, the offsets 190, the minor section 165 and accompanying parts, and the cable extension 152 have been removed from FIGS. 4 and 5.) The shielding element 160 may be shaped such that the lateral extensions 170 and 172 flex against the sidewalls 132 and 134, respectively, thereby forming an interference fit. When placed within the shell 104, the shielding element 160 may form a clearance $C_1$ between major body 168 of the main section 164 and the interior wall 130. To form the module assembly 100 (FIG. 1), a mating force $F_M$ is applied to bring the shells 104 and 106 securely together while the fastening devices (not shown) are inserted into the fastening holes 135 and 145 (FIG. 2). With reference specifically to the lateral extension 170 and corresponding spring member 180, when the mating edge 146 of the shell 106 contacts the spring member 180, the spring member 180 resists or deflects against the opposing force causing a portion of the spring member 180 that is adjacent to the sidewall 132 and the lateral extension 170 to flex away from the sidewall 132. Configuring the spring member 180 and the lateral extension 170 to flex away from the sidewall 132 may facilitate maintaining the deflective force against the mating edge 146 throughout the operation of the module assembly 100 and/or may also decrease the likelihood of the spring member 180 being plastically deformed.

When the spring members 180 are compressed between the corresponding mating edges 146, 136 and 148, 138 (FIG. 2), the outward flexion of the lateral extensions 170 and 172, respectively, may move the main section 164 further away from the interior wall 130 thereby increasing the clearance $C_1$ to a greater clearance $C_2$. A variety of factors affect the force-deflection behavior of the spring members 180, spring fingers 181, and/or the lateral extensions 170 and 172. For example, the angle of the respective spring member 180 or spring finger 181 with respect to the lateral extension 170 or 172, the composition of the material used to form the shielding element 160, the thickness of the shielding element 160, the depth of the spring recess(es) 184 (FIG. 3), and the operating temperature of the module assembly 100 may all affect the flexion of the lateral extensions 170, 172, spring members 180, and/or spring fingers 181.

It is to be understood that the above description is intended to be illustrative, and not restrictive. As such, the above-described embodiments (and/or aspects thereof) may be used in combination with each other. For example, two shielding elements 160 may be used within shell 104 and completely surround the circuitry within the cavity 108 (FIG. 5). As such, the shells 104 and 106 may be made from an insulative material. Also, one shielding element 160 may be placed within the shell 104 and an additional shielding element 160 may be positioned within the shell 106. When the shells 104 and 106 are mated securely together, the spring fingers 181 may be staggered such that each spring finger 181 may be adjacent to or between two spring fingers 181 from the other shielding element 160. Furthermore, the dimensions, types of materials, orientations of the various components, and the number and positions of the various components described herein are intended to support parameters of certain embodiments, and are by no means limiting and are merely exemplary embodiments. For example, the spring member 180/spring finger 181 may project at varying lengths from the mating corner 182 and/or the spring recesses 184 may vary in depth within one shielding element 160. Furthermore, if the spring member 180 includes a plurality of spring members 181, the spring fingers 181 may have different angles with respect to the corresponding lateral extension.

Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed:

1. An electrical connector module assembly comprising:

first and second shells mating together along an interface that extends along a length of the shells, the first and second shells forming a cavity therebetween that extends along the length of the shells, the cavity configured to hold an electrical component therein, the first shell having an interior surface; and a shielding element comprising a major body located along the interior surface of the first shell, the shielding element also including a spring member coupled to the major body, the spring member being compressed by and between the first and second shells within the interface such that the spring member flexes resiliently against the second shell as the first and second shells are mated together along the interface.

2. The module assembly in accordance with claim 1 wherein the spring member is configured to flex away from the first shell and against the second shell when compressed between the first and second shells.

3. The module assembly in accordance with claim 1 comprising a plurality of spring members compressed by and between the first and second shells within the interface such that the spring members flex resiliently against the second shell as the first and second shells are mated together along the interface.

4. The module assembly in accordance with claim 1 wherein the first shell includes an interior wall and opposing sidewalls connected together by the interior wall, the sidewalls projecting from and perpendicular to the interior wall.

5. The module assembly in accordance with claim 1 wherein the first shell includes an interior wall and opposing sidewalls connected together by the interior wall, the major body of the shielding element extending along the interior wall and forming a clearance therebetween.

6. The module assembly in accordance with claim 1 wherein the first shell includes an interior wall and opposing sidewalls connected together by the interior wall and the shielding element further comprises opposing lateral extensions connected by the major body, the major body extending along the interior wall and each lateral extension projecting upward along one corresponding sidewall.

7. The module assembly in accordance with claim 1 wherein the shielding element is stamped and formed from sheet metal.

8. The module assembly in accordance with claim 1 wherein the shielding element includes first and second sections formed by section recesses, wherein the first and second sections have different widths.

9. The module assembly in accordance with claim 1 wherein the spring member is a first spring member and wherein the shielding element includes first and second sections formed by section recesses, wherein the first section has said first spring member and the second section has a second spring member, said first spring member forming a plurality of fingers.

10. The module assembly in accordance with claim 1 wherein the spring member is a first spring member and the shielding element further comprises opposing lateral extensions connected by the major body, wherein the first lateral extension includes the first spring member and the second lateral extension includes a second spring member extending therefrom.

11. An electrical connector module assembly comprising:

a housing including a front end and a rear end having an opening into a cavity, the housing formed from first and second shells mating together along an interface that extends along a length of the shells, the first and second shells forming the cavity therebetween that extends along the length of the shells, the cavity configured to hold an electrical component therein, the first shell having an interior surface;

a shielding element comprising a major body located along the interior surface of the first shell, the shielding element also including a spring member coupled to the major body, the spring member being compressed by and between the first and second shells within the interface such that the spring member flexes resiliently against the second shell as the first and second shells are mated together along the interface; and a cable extending into the cavity through the rear opening of the housing, wherein the cable is electrically connected to the electrical component.

12. The module assembly in accordance with claim 11 wherein the spring member is configured to flex away from the first shell and against the second shell when compressed between the first and second shells.

13. The module assembly in accordance with claim 11 comprising a plurality of spring members compressed by and between the first and second shells within the interface such that the spring members flex resiliently against the second shell as the first and second shells are mated together alone the interface.

14. The module assembly in accordance with claim 11 wherein the first shell includes an interior wall and opposing sidewalls connected together by the interior wall, the sidewalls projecting from and perpendicular to the interior wall.

15. The module assembly in accordance with claim 11 wherein the first shell includes an interior wall and opposing sidewalls connected together by the interior wall, the major body of the shielding element extending along the interior wall and forming a clearance therebetween.

16. The module assembly in accordance with claim 11 wherein the first shell includes an interior wall and opposing sidewalls connected together by the interior wall and the shielding element further comprises opposing lateral extensions connected by the major body, the major body extending along the interior wall and each lateral extension projecting upward along one corresponding sidewall.

17. The module assembly in accordance with claim 11 wherein the shielding element is stamped and formed from sheet metal.

18. The module assembly in accordance with claim 11 wherein the shielding element includes first and second sections formed by section recesses, wherein the first and second sections have different widths.

19. The module assembly in accordance with claim 11 wherein the spring member is a first spring member and wherein the shielding element includes first and second sections formed by section recesses, wherein the first section has said first spring member and the second section has a second spring member, said first spring member forming a plurality of fingers.

20. The module assembly in accordance with claim 11 wherein the spring member is a first spring member and the shielding element further comprises opposing lateral extensions connected by the major body, wherein the first lateral extension includes the first spring member and the second lateral extension includes a second spring member extending therefrom.

* * * * *